US006967552B2

(12) United States Patent
Aoyama et al.

(10) Patent No.: US 6,967,552 B2
(45) Date of Patent: Nov. 22, 2005

(54) IGNITION COIL DEVICE AND METHOD OF MANUFACTURING THE SAME

(75) Inventors: Masahiko Aoyama, Kariya (JP); Kazuhide Kawai, Kariya (JP); Shouichi Takeyama, Hashima (JP)

(73) Assignee: Denso Corporation, (JP)

( * ) Notice: Subject to any disclaimer, the term of this patent is extended or adjusted under 35 U.S.C. 154(b) by 0 days.

(21) Appl. No.: 10/727,519

(22) Filed: Dec. 5, 2003

(65) Prior Publication Data

US 2004/0108930 A1 Jun. 10, 2004

(30) Foreign Application Priority Data

Dec. 5, 2002 (JP) ..... 2002-354154

(51) Int. Cl.[7] ..... H01F 27/02
(52) U.S. Cl. ..... 336/90; 336/92; 336/96
(58) Field of Search ..... 336/90, 96, 92; 123/634, 635

(56) References Cited

U.S. PATENT DOCUMENTS 6,215,385 B1 * 4/2001 Ogden ..... 336/96
6,469,608 B2 10/2002 Shimoide et al.

FOREIGN PATENT DOCUMENTS

| | | |
|---|---|---|
| JP | 7-230931 | 8/1995 |
| JP | 3026649 | 5/1996 |
| JP | 9-246070 | 9/1997 |

* cited by examiner

*Primary Examiner*—Anh Mai
(74) *Attorney, Agent, or Firm*—Nixon & Vanderhye PC

(57) ABSTRACT

An ignition coil device has a secondary spool, a secondary coil wound around the secondary spool, a coil insulating resin material that is impregnated into and cured in spaces between the windings of the secondary coil, a primary spool arranged on the secondary coil, a primary coil wound around the primary spool, and a high voltage tower that is arranged on one end side in the axial direction of these parts and is mounted with an ignition plug. At least one of two parts of the primary spool and the high voltage tower and the coil insulating resin material are integrally molded out of the same resin.

9 Claims, 9 Drawing Sheets

IGNITION COIL DEVICE AND METHOD OF MANUFACTURING THE SAME

CROSS REFERENCE TO RELATED APPLICATION

This application is based on and incorporates herein by reference Japanese Patent Application No. 2002-354154 filed on Dec. 5, 2002.

FIELD OF THE INVENTION

The present invention relates to a stick-type ignition coil device directly mounted in a plug hole of an internal combustion engine and a method of manufacturing the same.

BACKGROUND OF THE INVENTION

An ignition coil device in which an insulating resin material is vacuum-filled into the whole of a housing is disclosed as a stick-type ignition coil device in U.S. Pat. No. 6,469,608 (JP-2001-185430A). An axial cross-sectional view of an ignition coil device of the same type as the ignition coil device disclosed in the above patent document is shown in FIG. 9. As shown in this figure, an ignition coil device 100 has a center core 101, a secondary spool 102, a secondary coil 103, a primary spool 104, a primary coil 105, an outer peripheral core 106, a housing 107, and a high voltage tower 108.

The housing 107 is shaped like a cylinder. The center core 101 is shaped like a round bar and is arranged nearly in the radial center of the housing 107. The secondary spool 102 is cylindrical and is arranged on the outer peripheral side of the center core 101. The secondary coil 103 is wound around the outer peripheral surface of the secondary spool 102. The primary spool 104 is cylindrical and is arranged on the outer peripheral side of the secondary coil 103. The primary coil 105 is wound around the outer peripheral surface of the primary spool 104. The outer peripheral core 106 is shaped like a cylinder with a slit and is arranged on the outer peripheral side of the primary coil 105. The high voltage tower 108 covers the bottom end opening of the housing 107.

An epoxy resin 109 is filled from the top end opening of a housing 107 into the housing 107 and a high voltage tower 108 which are evacuated to a vacuum. Then, the epoxy resin 109 is cured in the spaces between the respective parts. The epoxy resin 109 ensures the insulation between the respective parts. Thus the epoxy resin 109 fixes the respective parts. However, the ignition coil device 100 has a large number of parts. For this reason, the ignition coil device 100 has a complicated structure and needs many assembling man-hours.

Moreover, a primary part of low voltage such as the primary coil 105 and a secondary part of high voltage such as the secondary coil 103 need to have a predetermined insulation dimension between them so as to prevent dielectric breakdown. However, in a method of manufacturing the ignition coil device 100, first, resin parts such as the secondary spool 102, the primary spool 104, the housing 107 and the high voltage tower 108 are molded separately, and then these molded parts are assembled. When they are molded, some of them cause molding defects such as shrinkage, warpage and twisting. In some cases, an unexpected percentage of shrinkage in molding and the deformation and wear of the mold cause dimensional errors. For this reason, in order to ensure a predetermined insulation dimension, it is necessary to incorporate these molding defects and dimensional errors into the dimensional tolerances of the respective resin parts and to set the dimensions and locations of the respective resin parts.

Here, the stick-type ignition coil device is directly mounted in a plug hole. For this reason, the outside diameter of the ignition coil device is regulated by the inside diameter of the plug hole. Thus, the outside diameter of the ignition coil device is preferably as small as possible. However, the outside diameter of the ignition coil device is inevitably enlarged by the integration of the dimensional tolerances of the respective resin parts.

Moreover, a high voltage transformer in which insulating resin material vacuum-filled into the spaces between the parts is integrally molded with a housing as disclosed in JP-A 7-230931. The application of the high voltage transformer can reduce the parts in number because the housing is integrally molded. Moreover, it is possible to remove the dimensional tolerances in a case where the housing is molded alone from the integration of the tolerances, that is, the integrated tolerances. However, the housing is comparatively simple in the construction of planes and has a small change in thickness. Thus, the housing resists causing molding defects and dimensional errors. The housing is a part for forming a cover of the ignition coil device and is not a part interposed between the primary windings and the secondary windings. Namely, the proportion of the dimensional tolerance of the housing to the integrated tolerances is small. For these reasons, the dimensional tolerance of the housing is essentially small. Therefore, it is difficult to reduce the outside diameter of the ignition coil device.

Moreover, JP-A 9-246070 and Japanese Utility Model 3026649 disclose an ignition coil device having no housing, that is, an ignition coil device whose outer peripheral core is exposed. In these ignition coil devices disclosed in these documents, insulating resin material is vacuum-filled into the whole inner peripheral portions of the outer peripheral core. According to these ignition coil devices, the parts can be reduced in number. Since the ignition coil devices are not provided with the housing, the dimensional tolerances of the housing can be removed from the integrated tolerances. However, the proportion of the dimensional tolerance of the housing to the integrated tolerances is small. The thickness of the housing itself is comparatively small. For this reason, even if the ignition coil device has no housing, it is difficult to reduce the outside diameter of the ignition coil device.

SUMMARY OF THE INVENTION

It is an object of the present invention to provide an ignition coil device having a small number of parts and a small outside diameter. It is another object of the invention to provide a simple method of manufacturing this ignition coil device.

An ignition coil device in accordance with the invention is characterized in that at least one of a primary spool and a high voltage tower and a coil insulating resin material are integrally molded out of the same resin.

That is, at least one of two parts of the primary spool and the high voltage tower and the coil insulating resin material are integrally molded out of the same resin. According to the ignition coil device of the invention, at least one of two parts of the primary spool and the high voltage tower and the coil insulating resin material become integrated into a single body. Hence, this can reduce the parts in number.

Further, the primary spool and the high voltage tower are complicated in the construction of planes as compared with a housing. Then, each of the primary spool and the high voltage tower has a large change in the thickness. On this account, the proportion of dimensional tolerances of both parts to the integrated tolerances becomes large. As a result, according to the ignition coil device of the invention, it is possible to reduce the outside diameter of the ignition coil device.

In particular, the primary spool is interposed between the secondary coil and the primary coil. For this reason, if the primary spool and the coil insulating resin material are integrally molded out of the same resin, the ignition coil device can be effectively reduced in the diameter.

It is more preferable to construct the ignition coil device in such a way that the spaces between the windings of the primary coil are not impregnated with the resin. Since a voltage applied to the primary coil is lower than a voltage applied to the secondary coil, it is not necessary to impregnate insulating resin material into the spaces between the windings of the primary coil to ensure the insulation between the windings. In this respect, according to this construction, the spaces between the primary windings are not impregnated with the resin. Hence, this can reduce the amount of use of the resin. As a result, this construction can reduce the manufacturing cost of the ignition coil device.

A method of manufacturing an ignition coil device in accordance with the invention is characterized by a spool arranging step of arranging a secondary spool having a secondary coil wound around its outer peripheral surface in a cavity of a mold having an inside surface formed in a shape symmetric with respect to a mold to at least one of a primary spool and a high voltage tower and by a part molding step of casting resin into the cavity having the secondary spool arranged therein and curing the resin to integrally mold out of the resin at least one of two parts of the primary spool and the high voltage tower and a coil insulating resin material impregnated into spaces between the windings of the secondary coil.

In the spool arranging step, the secondary spool is arranged in the cavity of the mold. The inside surface of the mold is formed in the shape symmetric with respect to a mold to at least one part of the primary spool and the high voltage tower. The secondary coil is previously wound around the outer peripheral surface of the secondary spool arranged in the cavity.

In the part molding step, first, the resin is cast into the cavity. The cast resin is filled into the cavity. At this time, the resin is impregnated also into the spaces between the secondary windings. In this step, next, the resin in the cavity is cured. Then, the mold is separated from the molded body. In this manner, at least one part of the primary spool and the high voltage tower is arranged outside the secondary spool. Then, the coil insulating resin material is interposed between the secondary windings.

According to the method of manufacturing an ignition coil device in accordance with the invention, it is possible to integrally mold at least one of two parts of the primary spool and the high voltage tower and the coil insulating resin material out of the same resin by a small number of man-hours with comparative ease.

Moreover, the insulation dimension of the ignition coil device can be determined by a spacing from the secondary windings to the inside surface of the mold. This can stably determine the size of he ignition coil device and hence reduce the integrated tolerances. As a result, the maximum insulation dimension can be reduced and the outside diameter of the ignition coil device can be reduced.

It is more preferable to construct the method of manufacturing an ignition coil device in such a way that the above construction, the resin is an injection molding resin and that the part molding step is an injection molding step of casting the injection molding resin into the cavity.

Namely, at least one part of the primary spool and the high voltage tower is arranged outside the secondary spool by the injection molding. Then, the spaces between the secondary windings are impregnated with the resin.

According to this construction, the time required to cure the resin can be reduced to a comparatively short time. Thus, this can improve the productivity of the ignition coil device. Moreover, according to this construction, the fluidity of the resin in the cavity is high. For this reason, the resin can be distributed to all portions in the cavity. Moreover, the spaces between the secondary windings can be sufficiently impregnated with the resin.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF THE EMBODIMENT

The preferred embodiments of an ignition coil device of the invention and the method of manufacturing the same will be described below.

(First Embodiment)

Figure 1:
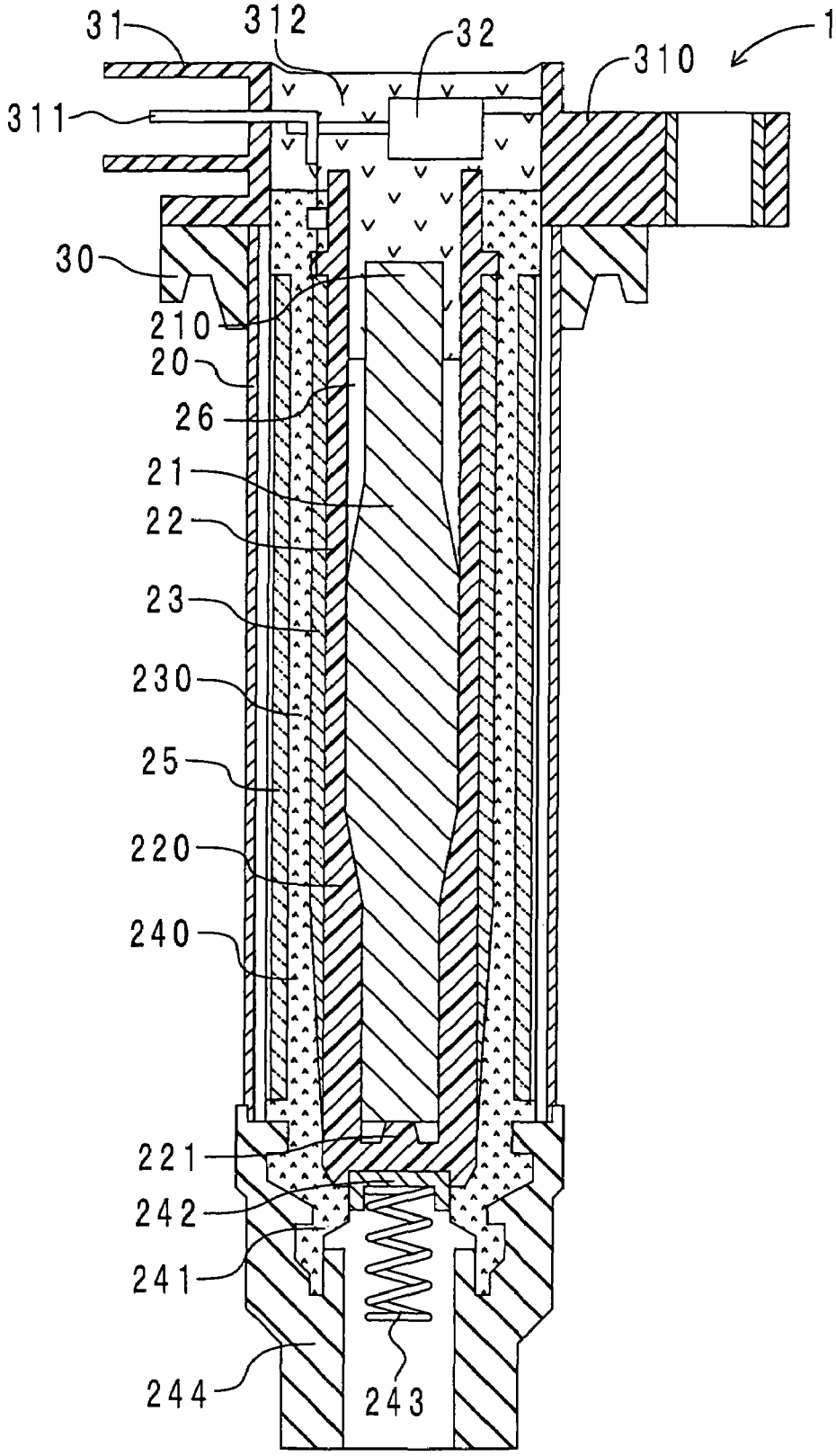
FIG. 1 is an axial cross-sectional view of an ignition coil device in accordance with a first embodiment of the present invention.

First, the construction of the ignition coil device of the present embodiment will be described. An axial sectional view of an ignition coil device of this embodiment is shown in FIG. 1. A stick-type ignition coil device 1 is stored in a plug hole (not shown) formed for each cylinder on the top of an engine block. The ignition coil device 1, as will be described below, is connected to an ignition plug (not shown) on the lower side in the figure.

The outer peripheral core 20 is made of a silicon steel plate and is shaped like a cylinder having a slit (not shown)

formed through in a longitudinal direction. A center core 21, a secondary spool 22, a secondary coil (windings) 23, a primary spool 240 and a primary coil (windings) 25 are stored in the inner peripheral side of the outer peripheral core 20. Each of the coils 23 and 25 are composed of a plurality of windings.

The center core 21 is manufactured by putting magnetic particles in a core mold and then by compressing the magnetic particles under conditions of a predetermined temperature and a predetermined pressure. The center core 21 is shaped like a round bar which is expanded in diameter at the center in a vertical direction.

The secondary spool 22 is molded out of resin and in the shape of a cylinder closed at an end. The secondary spool 22 is arranged on the outer peripheral side of the center core 21. The secondary spool 22 has a secondary spool body 220 and a bottom portion 221.

The secondary spool body 220 is shaped like a cylinder. The shape from the center to the bottom of the inner peripheral surface of the secondary spool body 220 is formed in a shape just symmetric with respect to a mold to the shape from the center to the bottom of the outer peripheral surface of the center core 21 opposed thereto. Hence, a portion below the center of the outer peripheral surface of the center core 21 abuts against and is held by the inner peripheral surface of the secondary spool body 220.

The bottom portion 221 closes the bottom end opening of the secondary spool body 220. The bottom portion 221 is formed in a protruding shape. The bottom end portion of the center core 21 is held by the bottom portion 221.

A cylindrical space 26 is formed between the upper portion of the outer peripheral surface of the center core 21 and the upper portion of the inner peripheral surface of the secondary spool body 220. The secondary coil 23 is wound around the outer peripheral surface of the secondary spool body 220. A coil insulating resin material 230 is impregnated into and is cured in the spaces formed between the wound secondary windings 23. The coil insulating resin material 230 is made of injection molding epoxy resin. The base material of this injection molding resin is epoxy.

The primary spool 240 is integrally molded out of the same injection molding epoxy resin as the coil insulating resin material 230. The primary spool 240 is molded in the shape of a cylinder and is arranged on the outer peripheral side of the secondary windings 23. The primary coil 25 is wound around the outer peripheral surface of the primary spool 240. Here, the spaces between the primary windings 25 are not impregnated with the resin.

The high voltage tower 241 is integrally mold out of the same injection molding epoxy resin as the primary spool 240 and the coil insulating resin material 230. The high voltage tower 241 closes the bottom end opening of the primary spool 240. The high voltage tower 241 surrounds the bottom portion 221 of the secondary spool 22.

A high voltage terminal 242, which is made of metal and is open downward and is formed in the shape of a cup, is placed nearly in the center of the high voltage tower 241. The high voltage terminal 242 is electrically connected to the secondary coil 23. A coil spring 243 made of metal is fixed to the cup bottom wall of the high voltage terminal 242. An ignition plug is in elastic contact with the coil spring 243. Then early whole surface of the high voltage tower 241 is covered with a plug cap 244 made of rubber. The ignition plug is pressed into the inner peripheral side of this plug cap 244. The bottom of the outer peripheral core 20 is put into the top of the plug cap 244.

On the other hand, a seal ring 30 made of rubber is annularly put on the top of the outer peripheral core 20. The seal ring 30 is in elastic contact with the edge of the entry of a plug hole. A connector 31 is placed on the seal ring 30. The connector 31 includes a case 310 and a plurality of connector pins 311. Here, the connector pins 311 are included in the connector terminal. The case 310 is molded out of resin and in the shape of an angular cylinder. An igniter 32 is arranged in the case 310. The igniter 32 has a power transistor (not shown), a hybrid integrated circuit (not shown) and a heat sink (not shown) formed therein and sealed with a mold resin.

The connector pins 311 are made of metal and are inserted into the case 310. The connector pins 311 are passed through the case 310 from inside to outside. The ends at the inside of the case 310 of the connector pins 311 are electrically connected to the secondary coil 23, the primary coil 25, and the igniter 32. On the other hand, the ends at the outside of the case 310 of the connector pins 311 are electrically connected t an ECU (engine control unit, not shown). The case 310 is filled with a connector insulating resin material 312. The connector insulating resin material 312 is made of epoxy resin. The base material of this epoxy resin is epoxy resin. That is, both of the base material of the connector insulating resin material 312 and the base material of the coil insulating resin material 230 are epoxy resin. However, the percentage of content of void of the connector insulating resin material 312 is made higher than the percentage of content of void of the coil insulating resin material 230.

The connector insulating resin material 312 grips the top end portion 210 of the center core 21. The connector insulating resin material 312 closes the top end of the space 26.

Next, an operation at the time of flow of electric current through the ignition coil device 1 of this embodiment will be described. A control signal from an ECU (not shown) is transmitted through the connector pins 311 to the igniter 32. When the igniter 32 supplies or stops the current, a predetermined voltage is generated on the primary windings 25 by a self-induction. This voltage is elevated by the mutual induction of the primary windings 25 and the secondary windings 23. The high voltage elevated by the mutual induction is transmitted from the secondary windings 23 through the high voltage terminal 242 and the coil spring 243 to the ignition plug. This high voltage generates a spark in the gap of the ignition plug.

Next, a method of manufacturing the ignition coil device 1 in accordance with this embodiment will be described. The method of manufacturing the ignition coil device 1 in accordance with this embodiment includes a step of arranging a spool and a step of injection molding.

Figure 2:
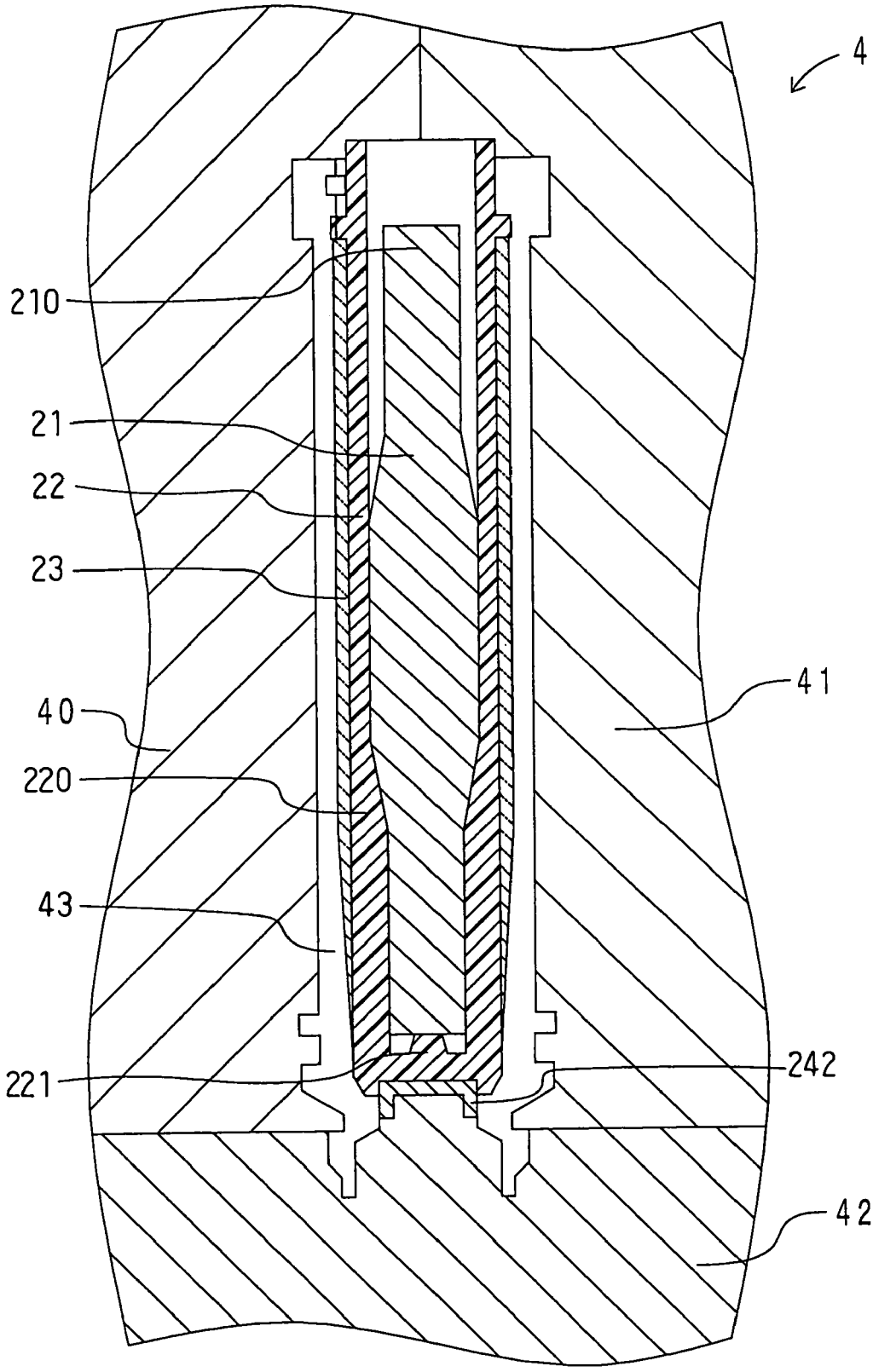
FIG. 2 is an axial cross-sectional view of a mold used in accordance with the first embodiment.

In the step of arranging a spool, first, the secondary spool is arranged in the cavity of a mold. An axial cross-sectional view of the mold is shown in FIG. 2. As shown in FIG. 2, a mold 4 includes a first mold 40, a second mold 41 and a third mold 42. The inside surface of the mold 4 is formed in a shape symmetric with respect to the mold to the outside surfaces of the primary spool and the high voltage tower. The secondary spool 22 previously injection-molded is arranged in the cavity 43 of the mold 4. The secondary coil 23 is wound around the outer peripheral surface of the spool body 220. The high voltage terminal 242 supported by the third mold 42 is fitted in the depressed portion of the bottom end of the bottom portion 221. The high voltage terminal 242 is previously connected to the secondary coil 23. The center core 21 previously formed by compression is inserted into the inner peripheral side of the secondary spool 22.

The bottom of the secondary spool 22 is supported by the third mold 42 via the high voltage terminal 242. On the other hand, the top of the secondary spool 22 is sandwiched between the first mold 40 and the second mold 41. In this manner, the secondary spool 22 is fixed in the cavity 43.

In the step of injection molding, next, the previously prepared injection molding epoxy resin is filled into the cavity 43 from the nozzle of an injection molding machine through a gate (not shown) which is open in the top of the cavity 43. The injection molding epoxy resin is distributed to all portions in the cavity 43 by injection pressure. At this time, the injection molding epoxy resin is impregnated also into the spaces between the secondary windings 23. Next, the cavity 43 is heated and is held at a predetermined temperature. The cavity 43 is cooled. The injection molding epoxy resin in the cavity 43 is thermally set by this series of temperature controls. Thereafter, the mold 4 is separated from a molded body and then its gate is cut off.

Figure 3:
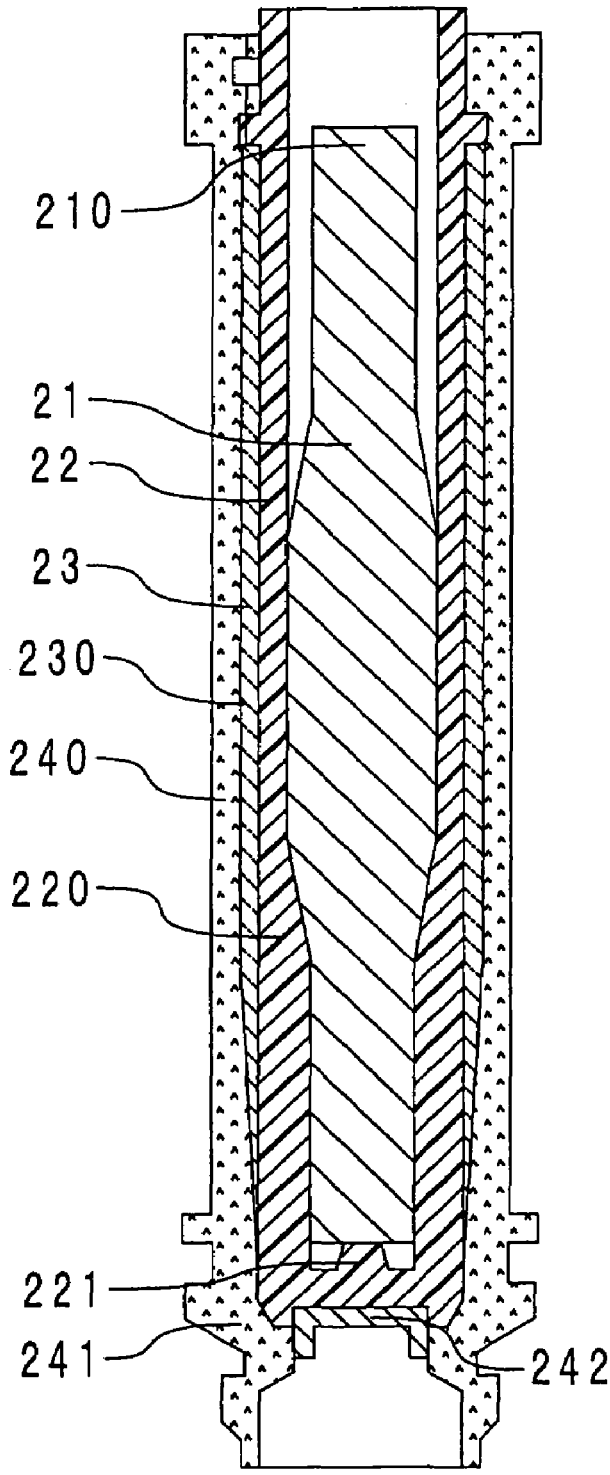
FIG. 3 is an axial cross-sectional view of a molded body after gate-cut in accordance with the first embodiment.

An axial cross-sectional view of the molded body after gate-cut is shown in FIG. 3. As shown in FIG. 3, the coil insulating resin material 230 and the primary spool 240 and the high voltage tower 241 are integrally manufactured of the cured injection molding epoxy resin. Moreover, the high voltage terminal 242 is fixed to the bottom portion 221 and the high voltage tower 241.

Figure 4:
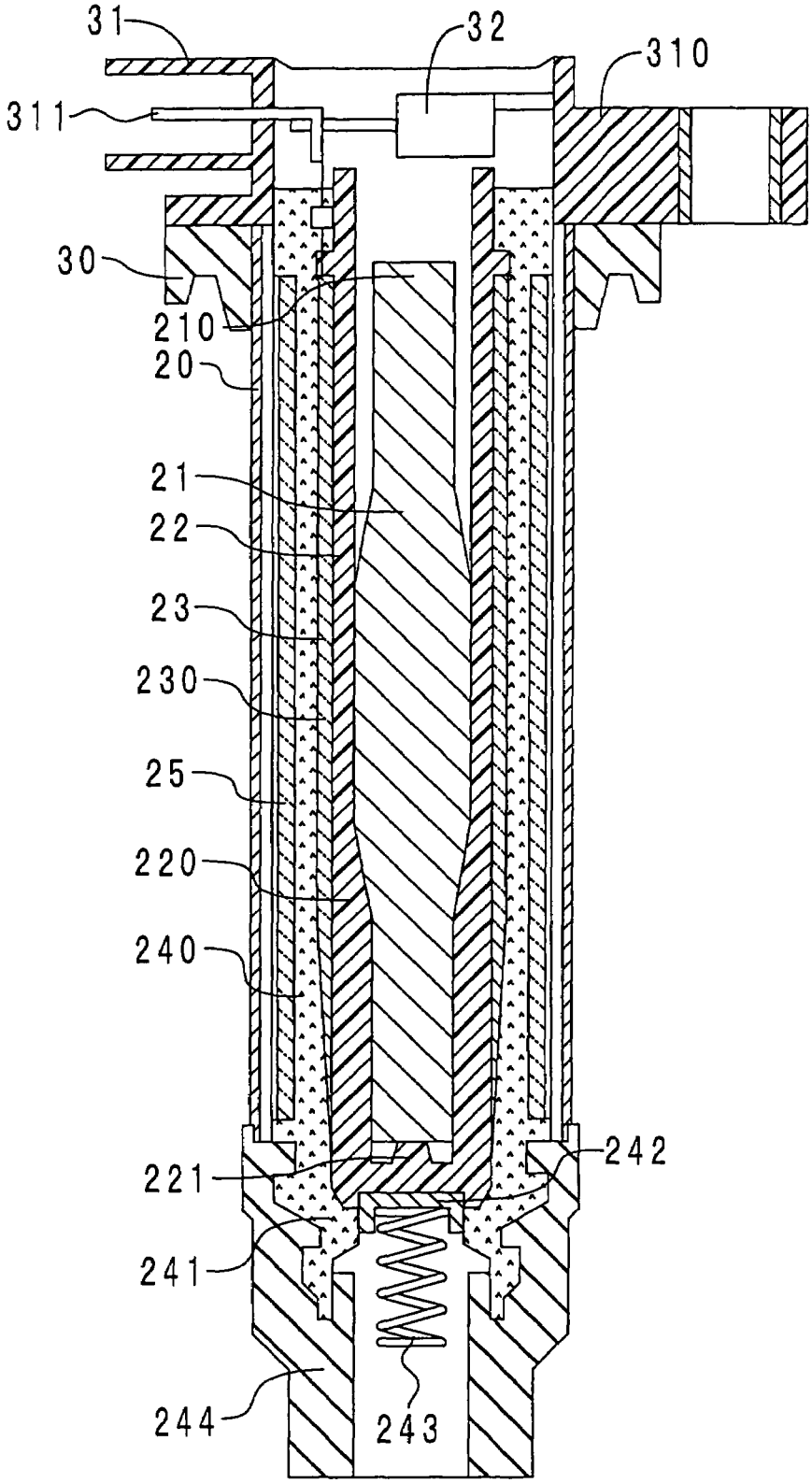
FIG. 4 is an axial cross-sectional view of a molded body mounted with other parts in accordance with the first embodiment of the present invention.

In this step, other parts are mounted on the molded body. An axial cross-sectional view of the molded body mounted with the other parts is shown in FIG. 4. The primary windings 25 are wound around the outer peripheral surface of the primary spool 240. The coil spring 243 is fixed to the high voltage terminal 242. Moreover, the plug cap 244 is put on the high voltage tower 241. The outer peripheral core 20 is put on the top of the plug cap 244. The seal ring 30 is annularly put on the outer peripheral surface of the top of the outer peripheral core 20. The previously assembled connector 31 is arranged on the outer peripheral core 20. The connector pins 311, the secondary coil 23, the primary coil 25 and the igniter 32 are connected to each other. In this step of filling the insulating resin material, first, a previously prepared epoxy resin is filled from the top opening of the case 310 into the case 310. The molded body is heated and is held at a predetermined temperature pattern and then is cooled. The epoxy resin in the case 310 is thermally set by this series of temperature controls. In this manner, the case 310 is filled with the connector insulating resin material 312 shown in FIG. 1. The top opening of the case 310 is closed. The top end 210 of the center portion 21 is gripped.

The kinetic viscosity of the epoxy resin is set at a comparatively high value. Thus, the fluidity of the epoxy resin is low. For this reason, the space 23 is formed below the connector insulating resin material 312. In this manner, the ignition coil device 1 of this embodiment is manufactured.

Next, the effects of the ignition coil device 1 and the method of manufacturing the same will be described. According to the ignition coil device 1 of this embodiment, the coil insulating resin material 230 and the primary spool 240 and the high voltage tower 241 are integrally molded of the same injection molding epoxy resin. For this reason, the parts can be reduced in number.

Further, the primary spool 240 and the high voltage tower 241 are complicated in the construction of planes. Moreover, each of the primary spool 240 and the high voltage tower 241 has a large change in thickness. For this reason, the proportion of dimensional tolerances of the two parts to the integrated tolerances is large. Thus, according to the ignition coil device 1 of the invention, it is possible to reduce the outside diameter of the ignition coil device 1.

Still further, according to the ignition coil device 1 of this embodiment, the spaces between the primary windings 25 are not impregnated with the resin. Thus, this can reduce the amount of use of the resin by the same amount and hence can reduce the manufacturing cost of the ignition coil device 1.

Still further, according to the method of manufacturing an ignition coil device in accordance with this embodiment, it is possible to integrally mold the coil insulating resin material 230, the primary spool 240 and the high voltage tower 241 of the same injection molding epoxy resin by a small number of man-hours with comparative facility.

Still further, according to the method of manufacturing an ignition coil device in accordance with this embodiment, the injection molding step is employed as a part molding step. The use of the injection molding can reduce the time required to cure the resin to a comparatively short time, for example, as compared with a case where resin is filled by vacuum casting. Then, it is not necessary to evacuate the cavity 43 to a vacuum. This can improve the productivity of the ignition coil device 1. Then, the injection molding can increase the fluidity of the resin in the cavity 43 and hence can distribute the resin to all the portions in the cavity 43. In addition, the injection molding can sufficiently impregnate the resin into the spaces between the secondary windings 23.

Still further, according to a mold 4 used in the method of manufacturing an ignition coil device 1 in accordance with this embodiment, a gate is formed in the top of the cavity 43. For this reason, the trace of the gate is formed on the top of the primary spool 240. It is likely that a strain is caused in the trace of the gate by a residual stress when the gate is cut off. However, the top of the primary spool 240 having the trace of the gate protrudes upward from the top of the secondary coil 23 and the top of the primary coil 25. This can reduce a possibility that even if a strain is produced, the strain develops a trouble such as dielectric breakdown. The top of the primary spool 240 is comparatively separated from the combustion chamber of the engine. Thus, the top of the primary spool 240 resists suffering the effect of combustion heat. This can also reduce a possibility that a trouble such as dielectric breakdown is caused by the strain.

(Second Embodiment)

This embodiment and the first embodiment differ in that a housing is arranged on the outer peripheral side of the outer peripheral core.

Figure 5:
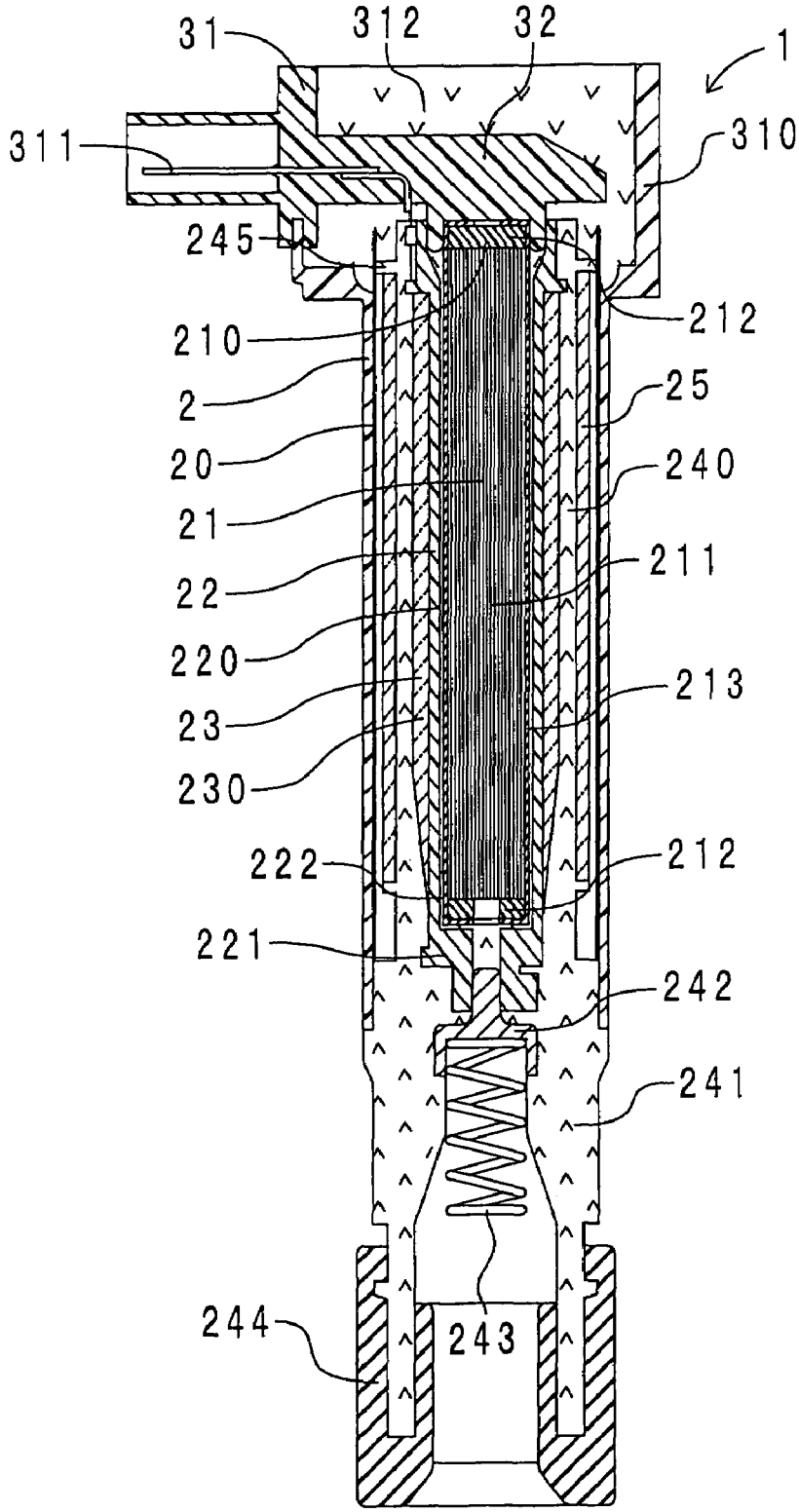
FIG. 5 is an axial cross-sectional view of an ignition coil device in accordance with a second embodiment of the present invention.

First, the construction of an ignition coil device in accordance with this embodiment will be described. FIG. 5 shows an axial cross-sectional view of an ignition coil device in accordance with this embodiment. Here, parts corresponding to those in FIG. 1 are designated by the same reference symbols. The seal ring 30 in FIG. 1 are omitted in FIG. 5.

As shown in FIG. 5, a housing 2 is molded of resin and in the shape of a cylinder. Parts of the center core 21, the secondary spool 22, the secondary windings 23, primary spool 240, the primary windings 25, and the outer peripheral core 20 are arranged in a coaxial manner inside the housing 2 in this order from the center to the outside in the radial direction. The center core 21 includes a core body 211, elastic parts 212 and a tube 213. The core body 211 is formed by laminating silicon steel rectangular plates having different widths. The core body 211 is formed in the shape of a round bar. The elastic part 212 is made of silicone and is formed in the shape of a short cylinder.

A total of two elastic parts 212 are arranged on the top and bottom of the core body 211. The tube 213 covers the core body 211 and the two elastic parts 212 from the outer peripheral side. The case 310 is integrally molded on the top end of the housing 2. The high voltage tower 241 is arranged below the housing 2. The high voltage tower 241, the primary spool 240 and the coil insulating resin material 230 are integrally molded of the same injection molding epoxy resin.

A flange 245 is molded on the outer peripheral surface on the top end of the primary spool 240. The flange 245 abuts against the inner peripheral surface of the outer peripheral core 20. A portion of the flange 245 is inserted also into a slit made in the outer peripheral core 20. The flange 245 separates the inside of the case 310 from the space between the outer peripheral surface of the primary spool 240 and the inner peripheral surface of the outer peripheral core 20. Here, the injection molding epoxy resin is filled also into the space between the outer peripheral surface of the tube 213 and the inner peripheral surface of the secondary spool 22. The high voltage terminal 242 and the coil spring 243 are arranged inside the high voltage tower 241. The plug cap 244 is put on the bottom end portion of the high voltage tower 241.

Next, a method of manufacturing the ignition coil device 1 in accordance with this embodiment will be described. The method of manufacturing the ignition coil device 1 in accordance with this embodiment has a spool arranging step and an injection molding step.

Figure 6:
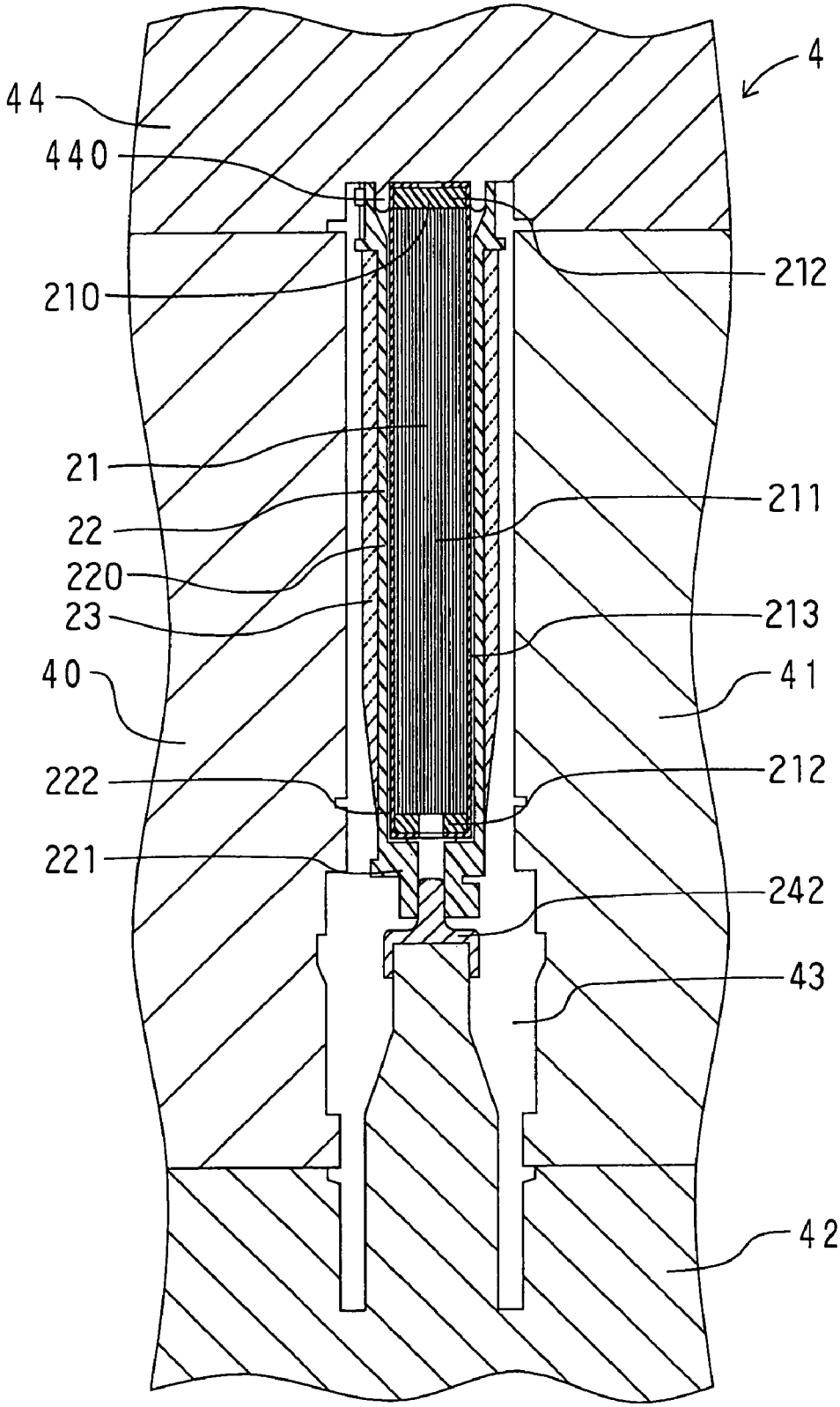
FIG. 6 is an axial cross-sectional view of a mold used in accordance with the second embodiment.

In the spool arranging step, first, the secondary spool is placed in the cavity of the mold. FIG. 6 shows an axial cross-sectional view of the mold. Here, parts corresponding to those in FIG. 2 are designated by the same reference symbols. As shown in FIG. 6, a mold 4 includes a first mold 40, a second mold 41, a third mold 42 and a fourth mold 44. The inside surface of the mold 4 is formed in the shape symmetric with respect to mold to the outside surfaces of the primary spool and the high voltage tower.

The secondary spool 22 previously injection-molded is placed in the cavity 43 of the mold 4. The secondary coil 23 is wound around the outer peripheral surface of the spool body 220. The high voltage terminal 242 supported by the third mold 42 is inserted into the bottom end opening of the bottom portion 221. The high voltage terminal 242 is previously connected to the secondary coil 23. The previously assembled center core 21 is inserted into the inner peripheral side of the secondary spool 22. The bottom end of the center core 21 is positioned by a support rib 222 which is shaped like a letter L and is formed around the inner peripheral surface of the bottom portion 221. On the other hand, a top end portion 210 is positioned by the inner peripheral surface of a ring rib 440 protruding from the inside surface of the fourth mold 44.

The bottom of the secondary spool 22 is supported by the third mold 42 via the high voltage terminal 242. On the other hand, the top of the secondary spool 22 is supported by the outer peripheral surface of the ring rib 440 of the fourth mold 44. In this manner, the secondary spool 22 is fixed in the cavity 43. A space is formed between the outer peripheral surface of the tube 213 and the inner peripheral surface of the secondary spool 22.

In the injection molding step, the previously prepared injection molding epoxy resin is filled into the cavity 43 through the gate (not shown) formed in the top of the cavity 43 from the nozzle of an injection molding machine (not shown). The injection molding epoxy resin is distributed into all the portions in the cavity 43 by injection molding pressure. At this time, the injection molding epoxy resin is impregnated also into the spaces between the secondary windings 23. The injection molding epoxy resin is flowed also into the spaces between the outer peripheral surface of the tube 213 and the inner peripheral surface of the secondary spool 22.

Figure 7:
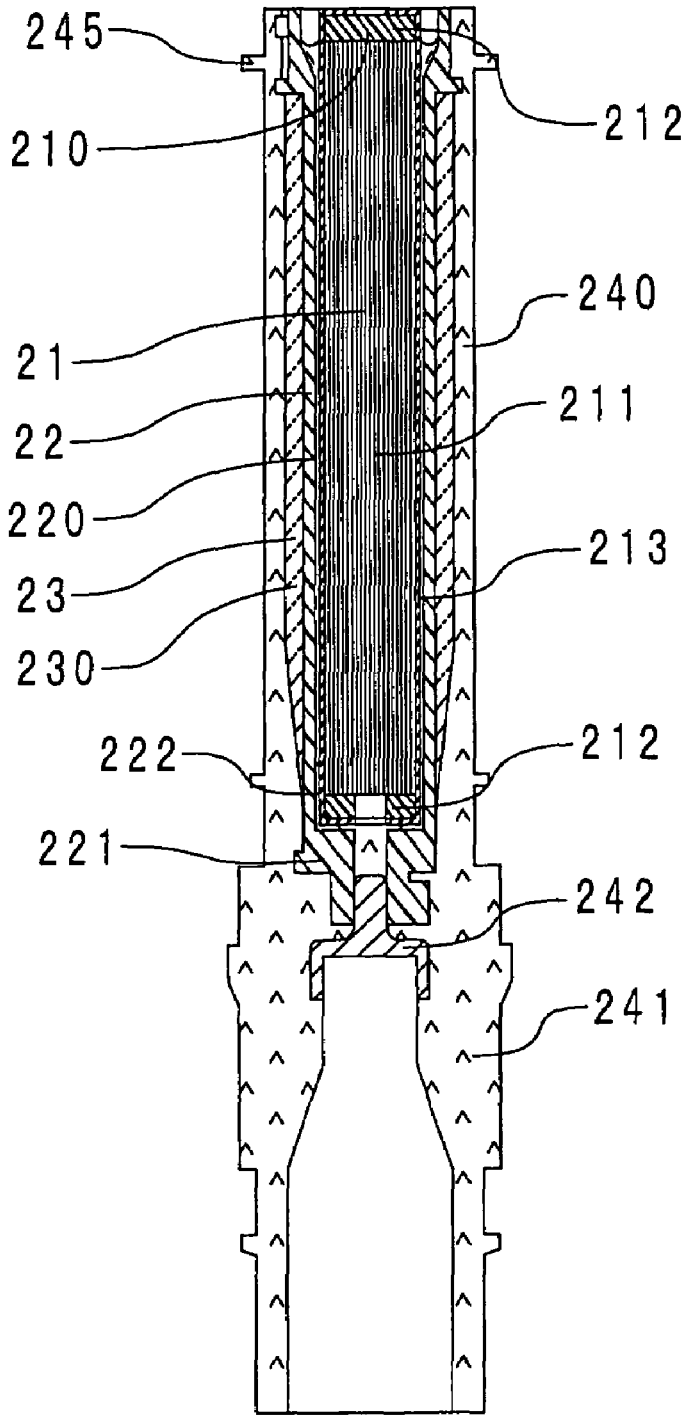
FIG. 7 is an axial cross-sectional view of a molded body after gate-cut in accordance with the second embodiment.

In this step, next, the cavity 43 is heated and held in a predetermined temperature pattern. The cavity 43 is cooled. The injection molding epoxy resin in the cavity 43 is thermally cured by this series of temperature controls. Thereafter, the mold 4 is separated from the molded body. The gate is cut off. FIG. 7 shows an axial cross-sectional view of the molded body after gate-cut. Here, parts corresponding to those in FIG. 3 are designated by the same reference symbols.

As shown in FIG. 7, the coil insulating resin material 230, the primary spool 240 and the high voltage tower 241 are integrally molded of the cured injection molding epoxy resin. The injection molding epoxy resin is between the outer peripheral surface of the tube 213 and the inner peripheral surface of the secondary spool 22. The high voltage terminal 242 is fixed to the bottom portion 221 and the high voltage tower 241.

Figure 8:
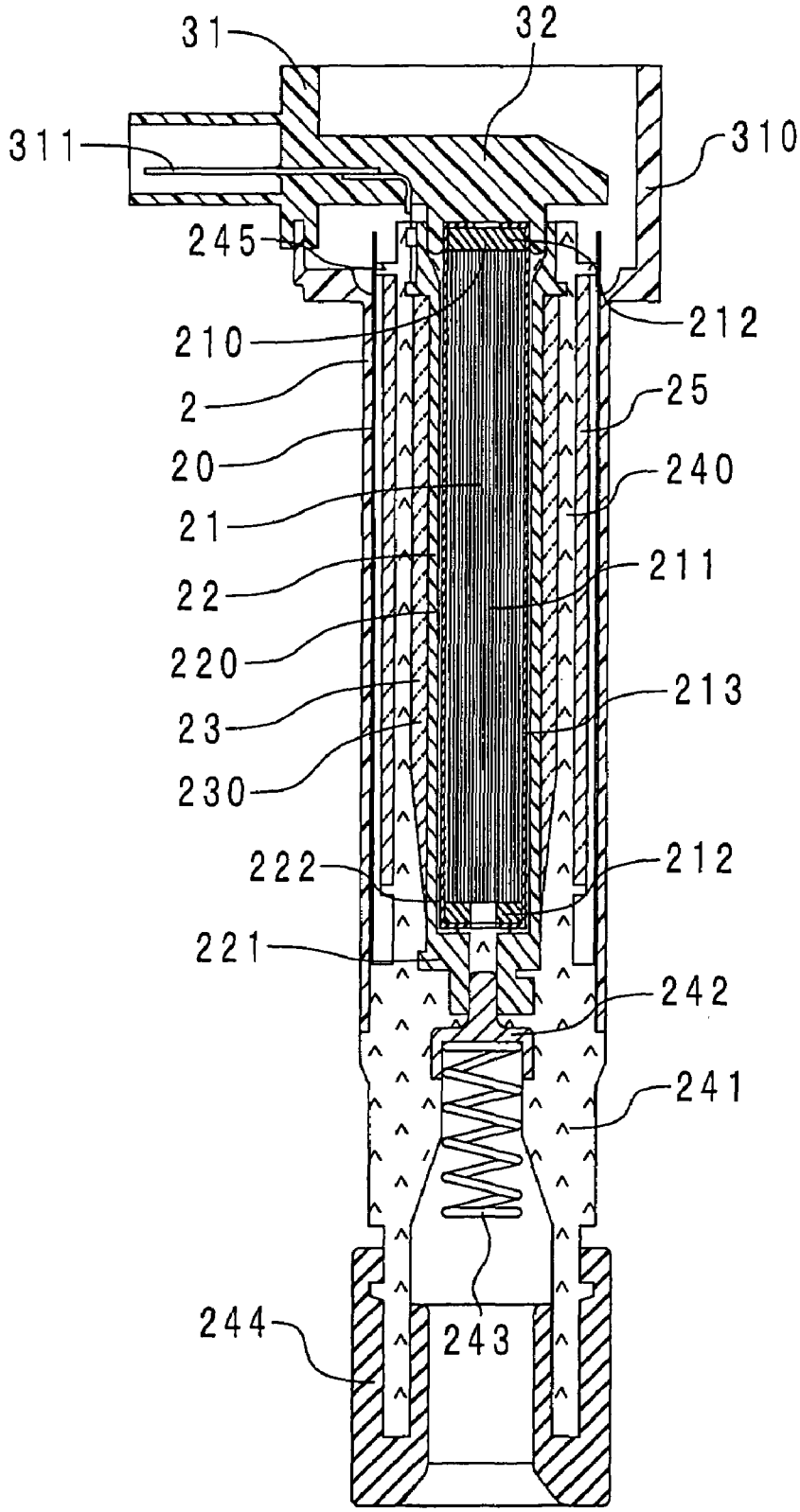
FIG. 8 is an axial cross-sectional view of a molded body mounted with other parts in accordance with the second embodiment.
Figure 9:
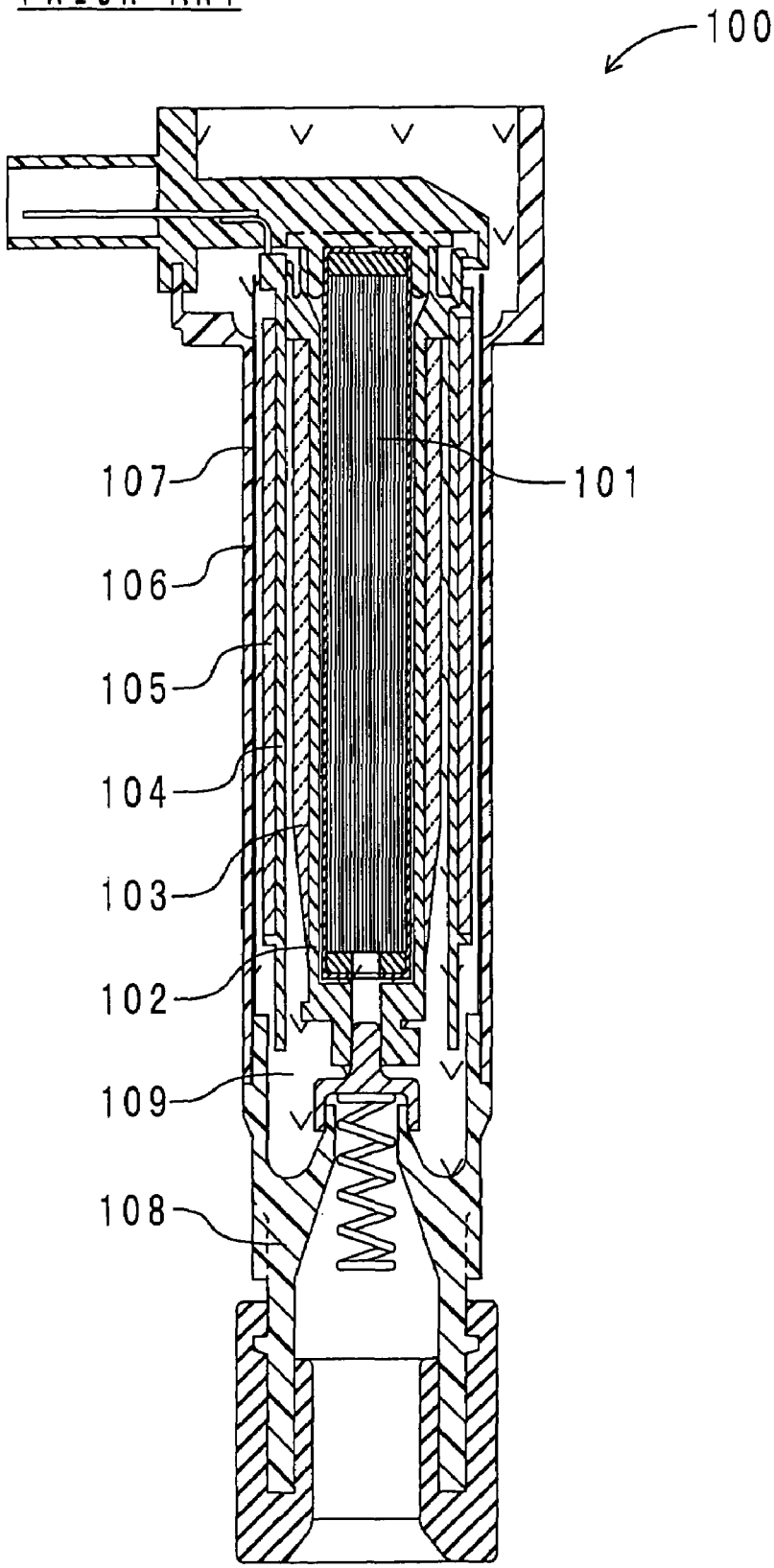
FIG. 9 PRIOR ART
FIG. 9 is an axial cross-sectional view of a conventional ignition coil device.

In this step, thereafter, other parts are mounted on this molded body. FIG. 8 shows an axial cross-sectional view of the molded body mounded with the other parts. Here, parts corresponding to those in FIG. 4 are designated by the same reference symbols. The primary coil 25 is wound around the outer peripheral surface of the primary spool 240. The coil spring 243 is fixed to the high voltage tower 242. The plug cap 244 is put on the high voltage tower 241. The outer peripheral core 20 and the housing 2 are put on the high voltage tower 214. The previously assembled connector 31 is placed on the top of the housing 2. The connector pins 311 are connected to the secondary coil 23, the primary coil 25, and the igniter 32.

In the step of filling the insulating resin material into connector, first, epoxy resin is filled from the top end opening of the case 310. At this time, the inside of the case 310 is separated from the space between the outer peripheral surface of the primary spool 240 and the inner peripheral surface of the outer peripheral core 20 by the flange 245. Thus, as shown in FIG. 5, the spaces between the primary windings 25 are not impregnated with the epoxy resin. In this step, next, the epoxy resin in the case 310 is cured. In this manner, the connector insulating resin material 312 is filled. The top end opening of the case 310 is closed. In this manner, the ignition coil device 1 in accordance with this embodiment is manufactured.

Next, the effects of the ignition coil device 1 in accordance with this embodiment and the method of manufacturing the same will be described. According to the ignition coil device 1 in accordance with this embodiment and the method of manufacturing the same, the effects produced in the first embodiment can be produced.

According to the ignition coil device 1 in accordance with this embodiment, the spaces between the outer peripheral surface of the tube 213 and the inner peripheral surface of the secondary spool 22 are also impregnated with the injection molding epoxy resin. For this reason, it is possible to reliably ensure the insulation between the core body 211 and the secondary windings 23.

(3) Others

The preferred embodiments of the ignition coil device of the invention and the method of manufacturing the same have been described above. However, it is not intended to limit the invention to these embodiments, but the invention can be put into practice in various modified embodiments and improved embodiments.

For example, in the above embodiment, the high voltage terminal 242 is arranged in the high-voltage tower 241. However, the high voltage terminal 242 does not need to be arranged. In this case, the secondary coil 23 can be directly connected to the coil spring 243.

Further, while the case 310 is filled with the connector insulating resin material 312 in the above embodiment, the case 310 and the connector insulating resin material 312 can be integrally molded of the same resin. This can further reduce the parts in number and the man-hours. Moreover, it is also recommended that the mold resin of the igniter 32 be integrally molded of the resin for molding the case 310 and the connector insulating resin material 312. This can further reduce the parts in number and the man-hours.

Still further, the primary spool 240, the high voltage tower 241 and the coil insulating resin material 230 are integrally molded. However, it is also recommended that only the primary spool 240 and the coil insulating resin material 230 be integrally molded. Alternatively, it is also recommended that only the high voltage tower 241 and the coil insulating resin material 230 be integrally molded. In these cases, it is possible to reduce the parts in number and to reduce the outside diameter of the ignition coil device.

Still further, while the spaces between the primary windings 25 are not impregnated with the resin, they can be impregnated with the resin. This can prevent the primary windings 25 from losing its winding shape and to improve the radiation of the primary windings 25.

Still further, the injection molding epoxy resin is used as the injection molding resin. The injection molding epoxy resin is not limited in its composition. For example, it is recommended that the epoxy resin, novolac-type phenol resin, and dimethyl urea resin be prepared in right amounts as the main material, a curing agent, and a curing accelerator, respectively.

Still further, while the gate is formed in the top of the cavity 43 in the above embodiment, the gate is not limited in its position. The gate is not limited in its kind. For example, a film gate and a ring gate can be used.

Still further, the secondary spool 22 is fixed in the cavity 43 only with the mold 4 in the above embodiment (FIG. 2 and FIG. 6). However, it is also recommended to fix the secondary spool 22 with a support pin inserted into the cavity 43 from outside the mold 4.

Still further, the injection molding step is employed as a part molding step. However, it is also recommended that the injection molding is not employed but, for example, vacuum casting is employed to manufacture the primary spool 240, the high voltage tower 241 and the coil insulating resin material 230.

Still further, the center core 21 is arranged in advance in the inner peripheral side of the secondary spool 22 in the spool arranging step in the above embodiment. However, the center core 21 can be arranged after the mold is removed.

According to the invention, it is possible to provide an ignition coil device having a small number of parts and a small outer diameter. Moreover, according to the invention, it is possible to provide a simple method of manufacturing this ignition coil device.

What is claimed is:

1. An ignition coil device comprising:

a cylindrical secondary spool;

a secondary coil of a plurality of secondary windings wound around an outer peripheral surface of the secondary spool;

a coil insulating resin material that is impregnated into and cured in spaces between the secondary windings;

a primary spool arranged on an outer peripheral side of the secondary windings; and a primary coil of a plurality of primary windings wound around an outer peripheral surface of the primary spool;

wherein the coil insulating resin material is integrally molded at the same time as and out of a same resin with the primary spool so that the coil insulating resin material defines and forms the primary spool and integrates the secondary coil and the primary spool into a single body.

2. The ignition coil device as claimed in claim 1, wherein spaces between the primary windings are not impregnated with resin.

3. The ignition coil device as claimed in claim 1, further comprising a high voltage tower that is arranged on one end of the primary spool in an axial direction and integrally molded with the primary spool from the coil insulating resin material.

4. The ignition coil device as in claim 1, further comprising:

an igniter; and a mold resin covering the igniter, said mold resin covering the igniter being different from the coil insulating resin material defining the primary spool.

5. An ignition coil device comprising:

a cylindrical secondary spool;

a secondary coil of a plurality of secondary windings wound around an outer peripheral surface of the secondary spool;

a coil insulating resin material that is impregnated into and cured in spaces between the secondary windings;

a primary spool arranged on an outer peripheral side of the secondary windings;

a primary coil of a plurality of primary windings wound around an outer peripheral surface of the primary spool; and a high voltage tower that is arranged at one end side of the primary spool in an axial direction, wherein the coil insulating resin material is integrally molded at the same time as and out of a same resin with at least one of the primary spool and the high voltage tower so that the coil insulating resin material defines and forms said at least one of the primary spool and the high voltage tower.

6. The ignition coil device as claimed in claim 5, wherein spaces between the primary windings are not impregnated with resin.

7. The Ignition coil device as claimed in claim 5, wherein the high voltage tower is integrally molded with the primary spool from the coil insulating resin material.

8. The Ignition coil device as in claim 5, further comprising:

an igniter; and a mold resin covering the Igniter, the mold resin covering the igniter is different from the coil insulating resin material.

9. The ignition coil device as in claim 5, wherein said coil insulating resin integrally defines and forms the primary spool and integrates the secondary coil and the primary spool into a single body.

* * * * *